US007926217B2

(12) United States Patent
McCann

(10) Patent No.: US 7,926,217 B2
(45) Date of Patent: Apr. 19, 2011

(54) SELF-SUPPORTING COMPOSITE MATERIAL FIREARM STOCK

(76) Inventor: Richard J. McCann, Spanaway, WA (US)

( * ) Notice: Subject to any disclaimer, the term of this patent is extended or adjusted under 35 U.S.C. 154(b) by 0 days.

(21) Appl. No.: 12/347,554

(22) Filed: Dec. 31, 2008

(65) Prior Publication Data

US 2010/0162608 A1 Jul. 1, 2010

(51) Int. Cl.
*F41A 21/48* (2006.01)

(52) U.S. Cl. ..... 42/75.03; 42/75.02

(58) Field of Classification Search ..... 42/75.03, 42/75.01, 75.1, 75.02
See application file for complete search history.

(56) References Cited

U.S. PATENT DOCUMENTS

| | | | | | |
|---|---|---|---|---|---|
| 768,665 | A | * | 8/1904 | Johnson | 89/145 |
| 1,206,234 | A | * | 11/1916 | Lovell | 42/71.01 |
| 2,205,891 | A | * | 6/1940 | Sprenger | 156/222 |
| 2,753,642 | A | | 7/1956 | Sullivan | |
| 3,011,283 | A | | 12/1961 | Lunn et al. | |
| 3,439,441 | A | * | 4/1969 | Lawley | 42/75.01 |
| 4,502,367 | A | * | 3/1985 | Sullivan | 89/181 |
| 4,512,101 | A | * | 4/1985 | Waterman, Jr. | 42/71.01 |
| 4,674,216 | A | | 6/1987 | Ruger et al. | |
| 4,934,084 | A | | 6/1990 | Thomas | |
| 5,483,766 | A | * | 1/1996 | Hochstrate et al. | 42/75.03 |
| 5,615,508 | A | | 4/1997 | Miller et al. | |
| 5,711,102 | A | | 1/1998 | Plaster et al. | |
| 5,797,207 | A | | 8/1998 | Marable et al. | |
| 5,864,978 | A | | 2/1999 | McRary et al. | |
| 6,012,246 | A | | 1/2000 | Robinson et al. | |
| 6,070,354 | A | * | 6/2000 | Burigana et al. | 42/71.01 |
| 6,080,493 | A | | 6/2000 | Kent | |
| 6,301,817 | B1 | | 10/2001 | Hogue et al. | |
| 6,427,372 | B1 | * | 8/2002 | Howard et al. | 42/71.01 |
| 6,487,806 | B2 | * | 12/2002 | Murello et al. | 42/75.03 |
| 6,662,485 | B2 | * | 12/2003 | Kay | 42/75.03 |
| 6,839,998 | B1 | * | 1/2005 | Armstrong | 42/71.01 |
| 6,843,876 | B1 | | 1/2005 | Kent | |
| 6,964,123 | B2 | | 11/2005 | Vicale | |
| 7,155,857 | B2 | | 1/2007 | Elder | |
| 7,191,557 | B2 | * | 3/2007 | Gablowski et al. | 42/72 |
| 7,216,451 | B1 | | 5/2007 | Troy | |
| 2004/0211104 | A1 | | 10/2004 | Eberle | |
| 2005/0241211 | A1 | | 11/2005 | Swan | |
| 2005/0252060 | A1 | | 11/2005 | Gonzalez | |
| 2007/0113459 | A1 | | 5/2007 | Stout et al. | |

OTHER PUBLICATIONS

Enhanced Battle Rifle Chassis Stock System Product Brochure, Sage International, Ltd., undated.
TROY 2008 Product Catalog, pp. 4 and 5, M14 Modular Chassis System.
VLTOR M14, M1A, SOCOM Series Modstock Webpage, printed Aug. 5, 2008.

* cited by examiner

*Primary Examiner* — Stephen M Johnson
(74) *Attorney, Agent, or Firm* — Wood, Herron & Evans LLP

(57) ABSTRACT

Shown is a firearm stock having a self-supporting structural shell made substantially of composite material. The shell includes an exterior wall and an interior wall, at least some portion of which is spaced from the exterior wall. A cavity in the shell is sized and shaped to accept and secure the barreled action of a firearm and has an interior volume defined at least in part by at least a portion of the interior wall. The stock also includes a means for attaching a butt stock with a standardized complementary attachment means.

24 Claims, 7 Drawing Sheets

SELF-SUPPORTING COMPOSITE MATERIAL FIREARM STOCK

TECHNICAL FIELD

This invention relates generally to a stock for a firearm, such as a rifle. More specifically, it relates to a firearm stock comprised of composite material in the form of a self-supporting shell that is extraordinarily lightweight, strong, and adaptable.

BACKGROUND OF THE INVENTION

The M14 rifle, formally the US Rifle, Caliber 7.62 mm, was adopted by the U.S. military in 1957. In January 1968, the U.S. Army officially replaced the M14 with the M16 as the "Standard A" rifle. Although officially phased out as the standard issue rifle, variants of the M14 continued to be used by various branches of the U.S. military, especially as a designated marksman rifle and/or a semiautomatic platform sniper rifle, due to its accuracy and effectiveness at long range.

Recently, there has been a need identified for a battle rifle with greater terminal ballistic performance than the 5.56 mm (.223 caliber) round delivered by the M16 and M4 carbine. The AR10's 7.62×51 mm NATO (.308 Win caliber) provides the desired terminal performance, but has been criticized for sharing the same direct impingement gas system of the M16/AR15. The M14 (or semiautomatic M21) delivers the 7.62 mm round with excellent accuracy. However, the common variants of the M14 stock were more suitable for use by a sniper or designated marksman than as a mainstream battle rifle. Its wooden stock and the polymer variants thereof are not suited for accessory rails or adjustable/interchangeable buttstocks or handgrips.

The M14 has been effectively transformed into a battle rifle by use of a replacement chassis stock system such as that described in U.S. Pat. No. 6,839,998, issued Jan. 11, 2005 and assigned to the U.S. Navy. This stock chassis system is manufactured by Sage International of Oscoda, Mich., out of aluminum or an alloy thereof and requires modification of the barreled rifle action by replacement of the operation rod guide with a member that is bolted to the replacement chassis. The adjustable buttstock assembly is unique to the design, limiting its interchangeability with the wide variety of buttstocks available for the M16/AR15 platform.

Troy Industries, Inc. of West Springfield, Mass., has introduced a "modular chassis system" for the M14 which also replaces the standard stock to provide forward accessory rails and which accepts standardized M16/AR15 buttstocks and handgrips. This chassis is also made entirely of aluminum, but adds significant weight to the weapon system.

The substantial mass of metal used in the chassis system described in the U.S. Pat. No. 6,839,998 patent or the Troy "modular chassis system" to support the barreled action acts as a significant heat sink. Heat generated by the firearm or absorbed from solar radiation will be retained and then radiated to the user. Likewise, when used in low ambient temperature conditions, the mass of metal can rapidly bleed body heat from the user. Injection molded polymer rifle stocks, including for the M14, have been made of various fiber-reinforced resins, including carbon fibers or mixtures of glass and carbon fibers. These stocks, however, are solid in form (with the exception of some portion of the buttstock) or (as shown in U.S. Pat. No. 4,934,084) are a shell requiring internal reinforcement with a resin matrix or (as shown in U.S. Pat. No. 5,615,508) are built up over a foam or wood core in order to provide sufficient strength characteristics. Traditional solid core or injection molded synthetic stocks often include a metal (aluminum) bedding block in order to provide a sufficiently stiff foundation against which to bed the action and/or barrel with epoxy or other bedding material.

U.S. Pat. No. 6,839,998 states that "the chassis 22 may be an assembly of two or more components (such as frame and rails embedded in composite materials)." Accordingly, it was unexpected at the time of the present invention that a stock made of a shell of composite material would provide sufficient strength to be self supporting without the inclusion of an embedded frame or structural core.

SUMMARY OF THE INVENTION

The present invention provides a self-supporting composite material firearm stock having a self-supporting structural shell made substantially of composite material. The shell includes an exterior wall and an interior wall, at least some portion of which is spaced from the exterior wall. A cavity in the shell is sized and shaped to accept and secure the barreled action of a firearm and has an interior volume defined at least in part by at least a portion of the interior wall. The stock also includes a means for attaching a buttstock with a standardized complementary attachment means.

An empty space may be defined between the exterior and interior walls. Filling the space with foam or other lightweight, nonstructural material, while not inherently detrimental, is unnecessary.

In a preferred form, the stock may be made substantially of resin-impregnated woven carbon fiber and made to accept the barreled action of a standard M14 rifle (or the semiautomatic version commonly known as the M21 or the M1A®, the latter being a trademark of Springfield Armory, Inc.) without modification. The stock may also include a standardized means for attaching a handgrip and have standardized accessory rails on the top, bottom, and/or sides of a forearm portion.

Other features, aspects and objects of the present invention will be apparent from the various figures of the drawing and written description of a preferred embodiment which, together with any later-appended claims, make up the entire disclosure of the present invention.

BRIEF DESCRIPTION OF THE DRAWING

Like reference numerals are used to indicate like parts throughout the various figures of the drawing, wherein.

DETAILED DESCRIPTION OF THE INVENTION

Figure 1:
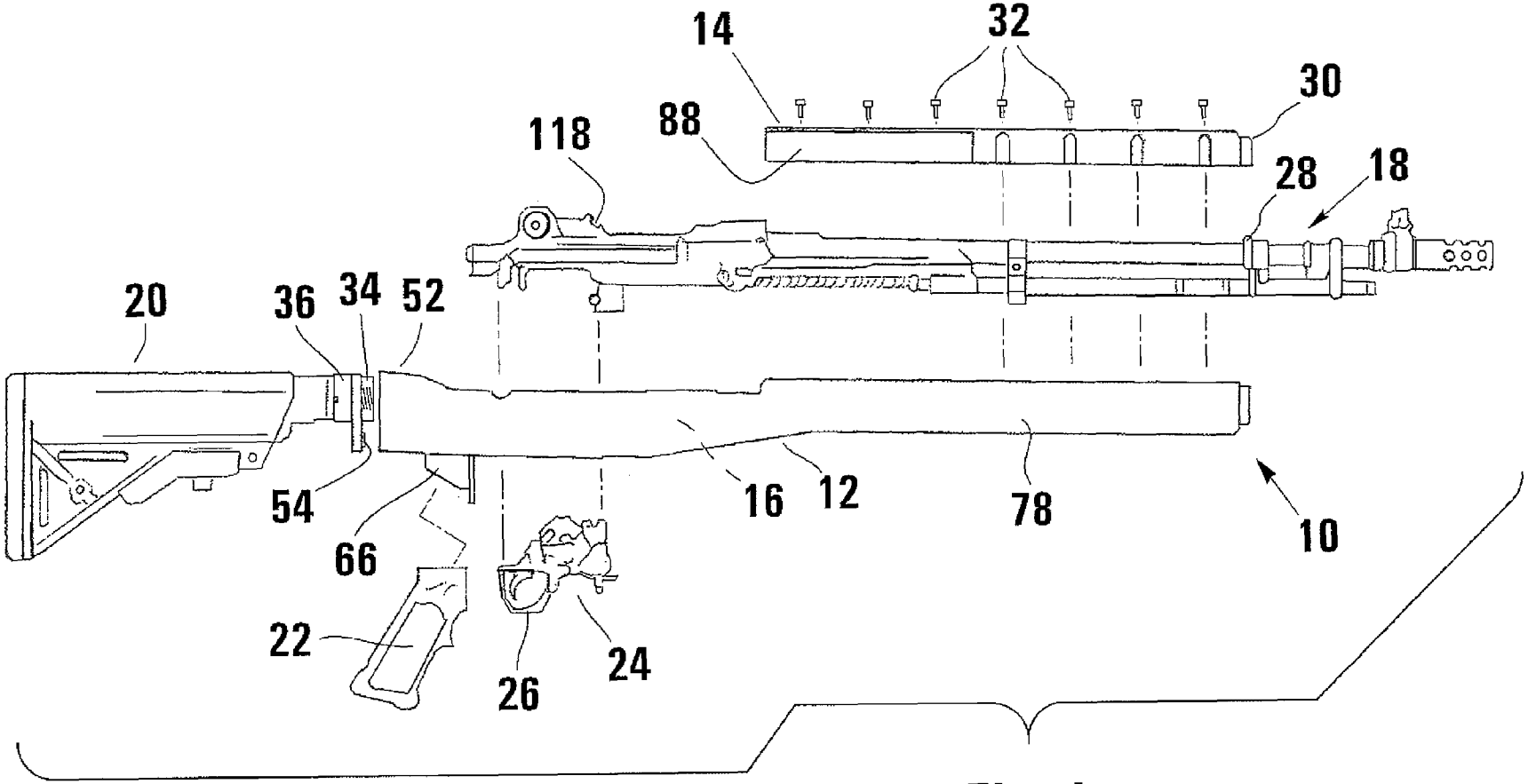
FIG. 1 is a side exploded view of a preferred embodiment of the present invention along with the barreled action and trigger group of a standard M14 rifle, as well as a hand grip and buttstock with standardized corresponding attachment means, both common to the M16, M4, and AR15 platforms.

Referring to the various figures of the drawing, and first to FIG. 1, therein is shown at 10 an embodiment of the present invention which incorporates certain preferred features. The stock 10 includes a self-supporting structural shell 12 made substantially of composite material and may include a separate, attachable handguard 14, also made substantially of composite material. The stock 10 includes a cavity 16 in the shell 12 that is sized and shaped to accept and secure a barreled action 18 of a firearm, such as the M14. As used herein, M14 refers also to its semiautomatic variants known as the M21 or M1A®. At a rearward end of the shell 12, the stock 10 includes an integral means for attaching a buttstock 20 having a standardized complementary attachment means. In one preferred form, the attachment means is a threaded opening mimicking that found at the rearward end of an M16/AR15 lower receiver. This standardized connection can accept a wide variety of fixed, adjustable, or folding buttstock configurations commonly available on the market today.

The stock 10 may also include a hand grip 22. In preferred form, the hand grip 22 may be removably attached to the stock 10 by a standardized complementary attachment means, also similar to that found on the M16/AR15 platform. A wide variety of pistol grip hand grips 22 are available on the market which use this standardized attachment interface.

The stock 10 of the present invention can be made to accept the barreled action 18 and trigger mechanism 24 of a standard M14 rifle, for example, without modification. A prior art wooden or synthetic stock (not shown) can be removed from the standard rifle simply by rotating the trigger guard 26 to a disengaged position, removing the trigger assembly 24, and then lifting the barreled action 18 out of the prior stock. The prior art handguard (not shown) is removed from the barreled action 18 by disengagement of a handguard clip and lifting the forward end out of the front band 28. The stock 10 of the present invention may be used simply by dropping the barreled action 18 into the cavity 16 of the shell 12, inserting the trigger mechanism 24, and engaging the trigger guard 26. A composite material handguard 14 may be attached by inserting its forward end 30 into the front band 28 and engaging a plurality of machine screws 32, as described in greater detail below.

A standardized buttstock 20 is attached to the structural shell 12 by threaded engagement 34 and tightening the castle-nut 36. The pistol grip 22 is attached in place using a machine screw (not shown).

Figure 2:
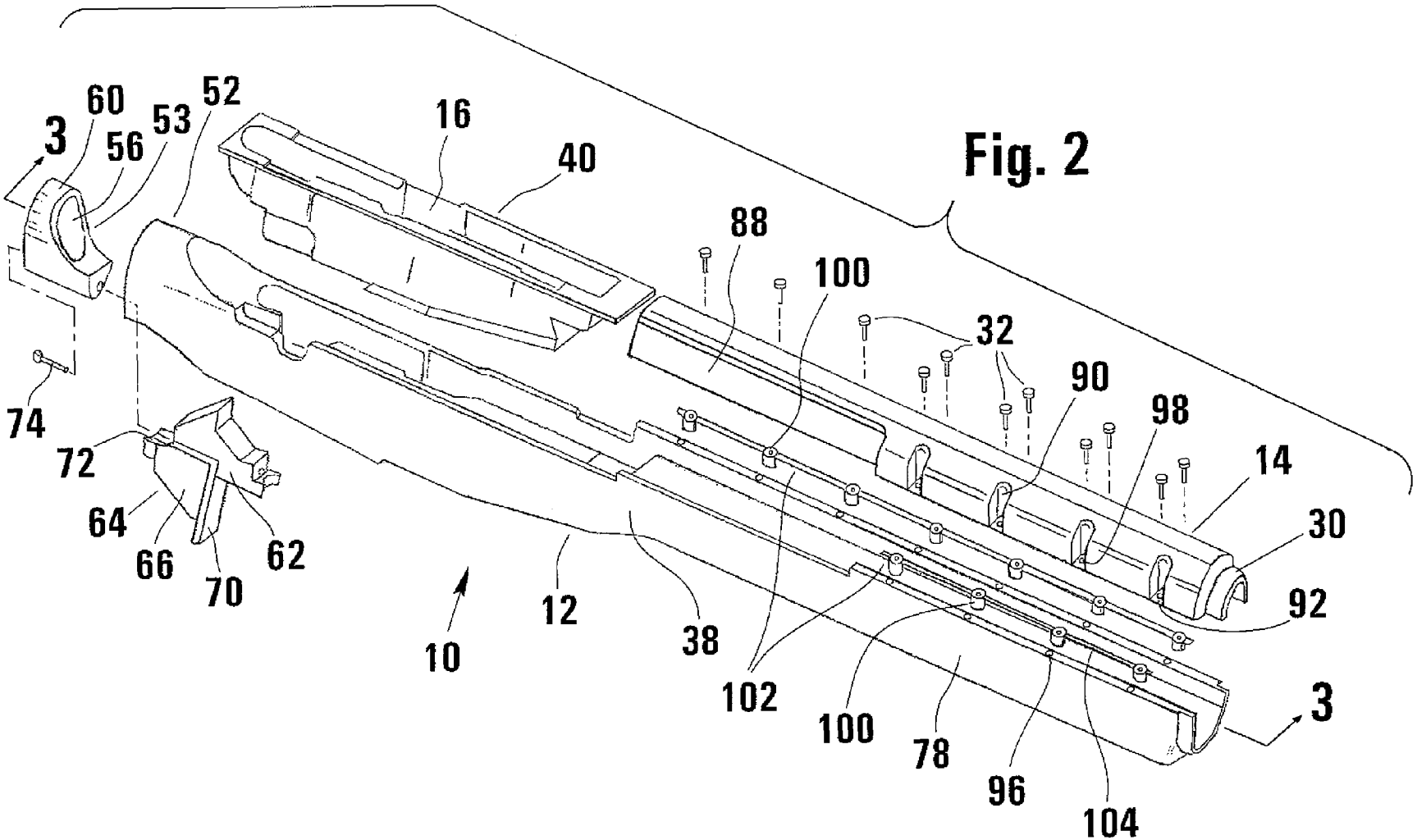
FIG. 2 is a pictorial exploded view of the component parts of a preferred embodiment of the self-supporting composite material firearm stock.
Figure 3:
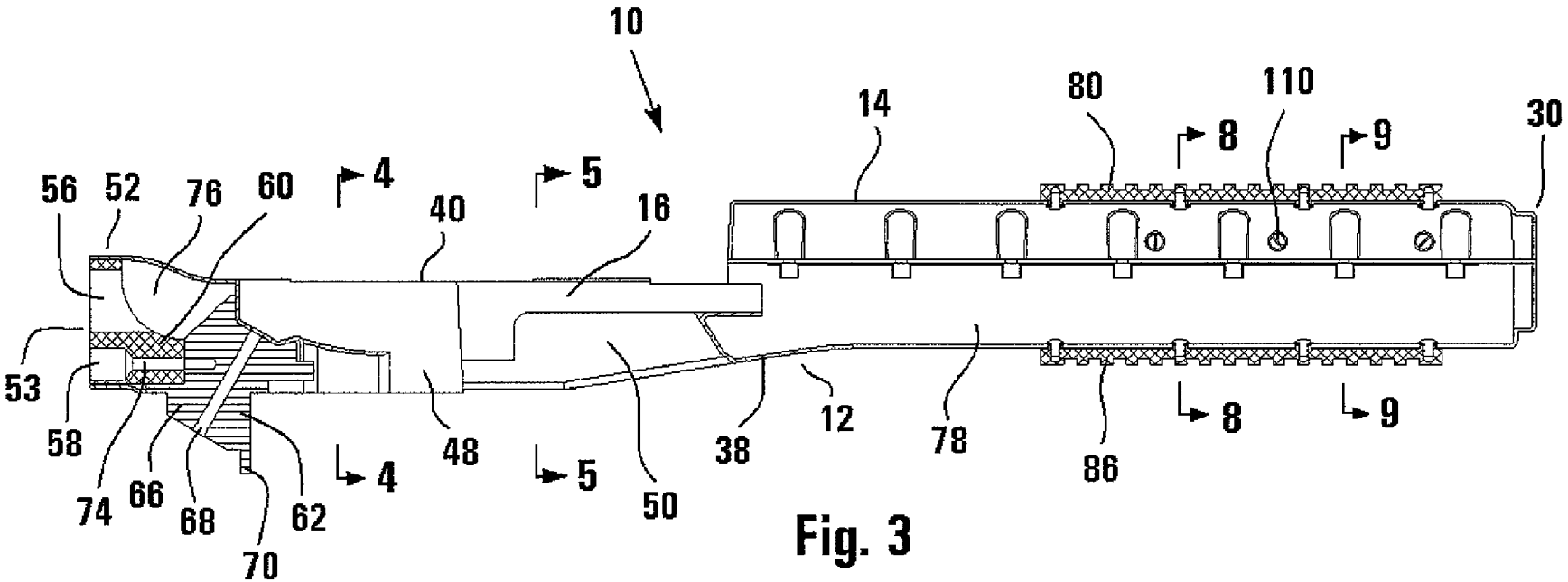
FIG. 3 is an assembled longitudinal sectional view taken substantially along line 3-3 of FIG. 2.
Figure 5:
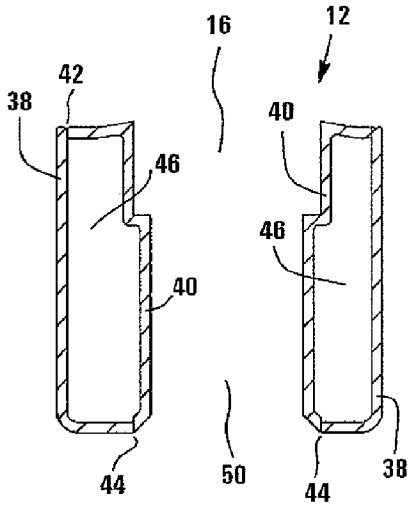
FIG. 5 is a cross-sectional view taken substantially along line 5-5 of FIG. 3.
Figure 4:
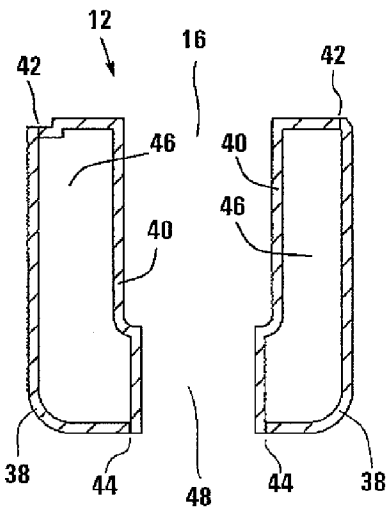
FIG. 4 is a cross-sectional view taken substantially along line 4-4 of FIG. 3.

Referring now to FIGS. 2 and 3, it can be seen that the structural shell 12 is comprised of two main parts: an exterior shell wall 38 and an interior shell wall 40. According to one embodiment of the invention, the interior shell wall 40 is formed as a separately cured piece which, after trimming, is permanently assembled with the exterior shell wall 38 by adhesively or otherwise bonding the parts together. The interior shell wall 40 defines the cavity 16 which is sized and shaped to accept and secure the barreled action 18 of a firearm. The interior cavity 16 can be dimensioned precisely in order to securely bed the firearm receiver or action. If desired, however, the cavity 16 will accept epoxy or other resin bedding materials to provide a custom fit. The integration of the exterior and interior shell walls 38, 40, at least some portion of which are spaced apart from one another (as seen in FIGS. 4 and 5), gives the structural shell 12 an unexpected degree of strength and rigidity without the need for an embedded frame or core material.

In preferred form, the composite material of the exterior and interior shell walls 38, 40 (as well as the removable handguard 14) are made from multiple layers of resin-impregnated woven carbon fiber fabric which is heat and/or pressure cured. For example, eight layers of a bi-directional fiber orientation fabric with an epoxy resin has been found to perform well. Thermoplastic or thermoset resins may also provide acceptable performances, as may glass or other fibers for reinforcement.

A multi-part cavity mold can be manufactured to the specified exterior dimensions of the exterior shell wall 38. Multiple layers of uncured pre-preg composite material is "laid up" in the mold cavity according to a commonly-known method. An internal mandrel can be used to press the layers of composite material firmly into the mold cavity, removing all air bubbles and voids during heat and/or pressure curing.

The interior shell wall 40 similarly may be "laid up" over a mandrel (not shown) dimensioned to define the interior cavity space 16. This part 40 is separately heat and/or pressured cured. The components 38, 40 are trimmed and permanently bonded together using adhesive or other composite material connection. The handguard 14 may be manufactured in a manner similar to that of the exterior shell wall 38, described above.

Referring now also to FIGS. 4 and 5, it can be seen that the exterior and interior shell walls 38, 40 are bonded together along upper edge seams 42 and lower edge seams 44. The exterior and interior shell walls 38, 40 are laterally spaced apart from one another along at least a portion of the length of the shell 12. An empty space 46 may be defined between the shell walls 38, 40 to create a structure of substantially parallel box beams. This construction contributes to and enhances the rigidity and ability of the stock 10 to be self-supporting without the need for a core material or imbedded reinforcement frame of any kind. The space 46 could be filled with a foam or other lightweight material simply for the purpose of displacing air, but is not deemed necessary or to have any particular desired effect.

The interior cavity 16 has a generally open top into which the barreled receiver 18 (not show in FIGS. 4 and 5) is inserted. Along certain portions of the bottom of the shell 12, the cavity 16 is open to define an access opening 48 (FIG. 4) for the trigger mechanism 24. Forward of the bottom opening 48, the interior cavity 16 may have a separate or continuing bottom opening 50 which defines or accepts a magazine well in the case of a firearm that utilizes a detachable ammunition box magazine (not shown). Depending on the configuration of the particular firearm for which the stock 10 is configured, the interior shell wall 40 and exterior shell wall 38 may be spaced apart along bottom portions, further defining an interior space in addition to the space 46 defined laterally. In such an embodiment, the self-supporting structural shell 12 would derive strength and rigidity from a double channel configuration, providing structural characteristics similar to the double box beam configuration described above.

Referring again to FIGS. 2 and 3, a rearward end 52 of the structural shell 12 includes means 53 for attaching a buttstock 20 having a standardized complimentary attachment means. In a case of a buttstock 20 (FIG. 1) configured for standardized attachment to an M16/M4/AR15, there is a threaded member 34 with an eccentric alignment key 54 which is offset in a downward direction. In the present invention, means 53 for attaching a buttstock 20 includes an internally threaded socket 56 with a downwardly offset opening 58 sized and positioned to receive and retain member 54.

The attachment means 53 could be integrally formed by or machined into the rearward end 52 of the structural shell 12. In preferred form, however, a separately fabricated insert member 60, preferably constructed of metal (such as aluminum) or a durable composite material, may be fitted and adhesively bonded into the structural shell 12 to present a strong and flat surface for engagement with a detachable buttstock 20. Although the shell 12 is self-supporting, the use of an insert member 60 or sleeve made of metal or a fiber-reinforced resin provides more durable threads for a removably attachable connection than using resin-impregnated woven fabric composite material. Furthermore, the non-round shape of the preferred insert member 60 provides a more secure integration into the shell 12 than would an ordinary round, internally-threaded sleeve.

A second insert member 62 may be used to provide a means 64 for attaching a hand grip 22 having a standardized complimentary attachment means. In preferred form, this includes a mounting flange portion 66 which is configured to be engaged by any of a wide variety of hand grips standardized for attachment to the M16/M4/AR15 platform. The mounting flange 66 includes an angled opening internally threaded to receive a machine screw (not shown) internally inserted through the hand grip 22. This threaded opening 68 may be a blind opening or, as shown in FIG. 3, may be formed as a through-hole. Composite material of the interior shell wall 40 may or may not cover the inward end of the opening 68, as desired. Insert member 62 may optionally include a downwardly-extending forward flange 70 for positioning the hand grip 22 relative to the trigger guard 26. The hand grip attachment means 64 insert member 62 preferably is constructed of material similar to that of the buttstock attachment member 60.

Figure 6:
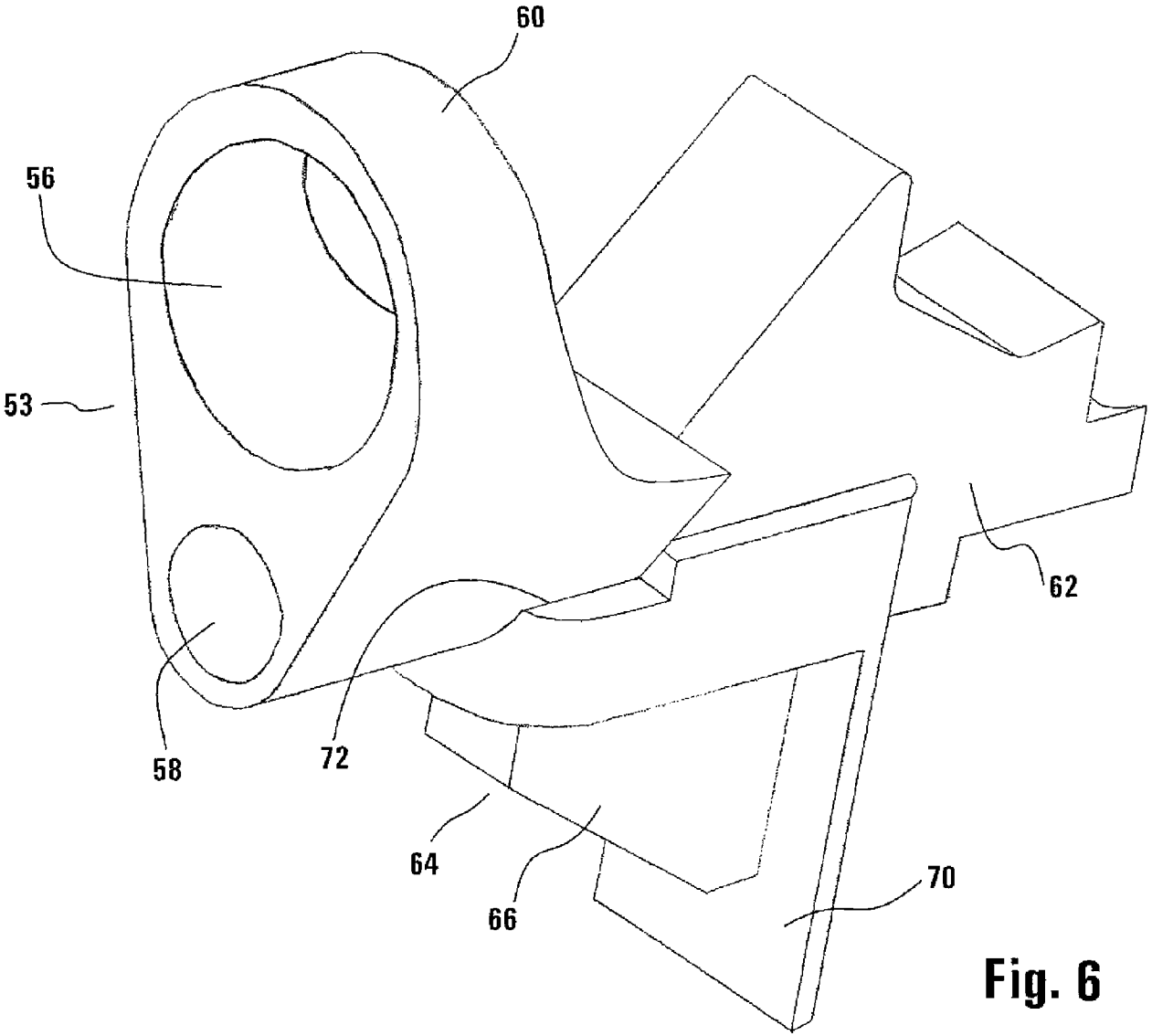
FIG. 6 is a pictorial view of mounting members according to a preferred embodiment.
Figure 7:
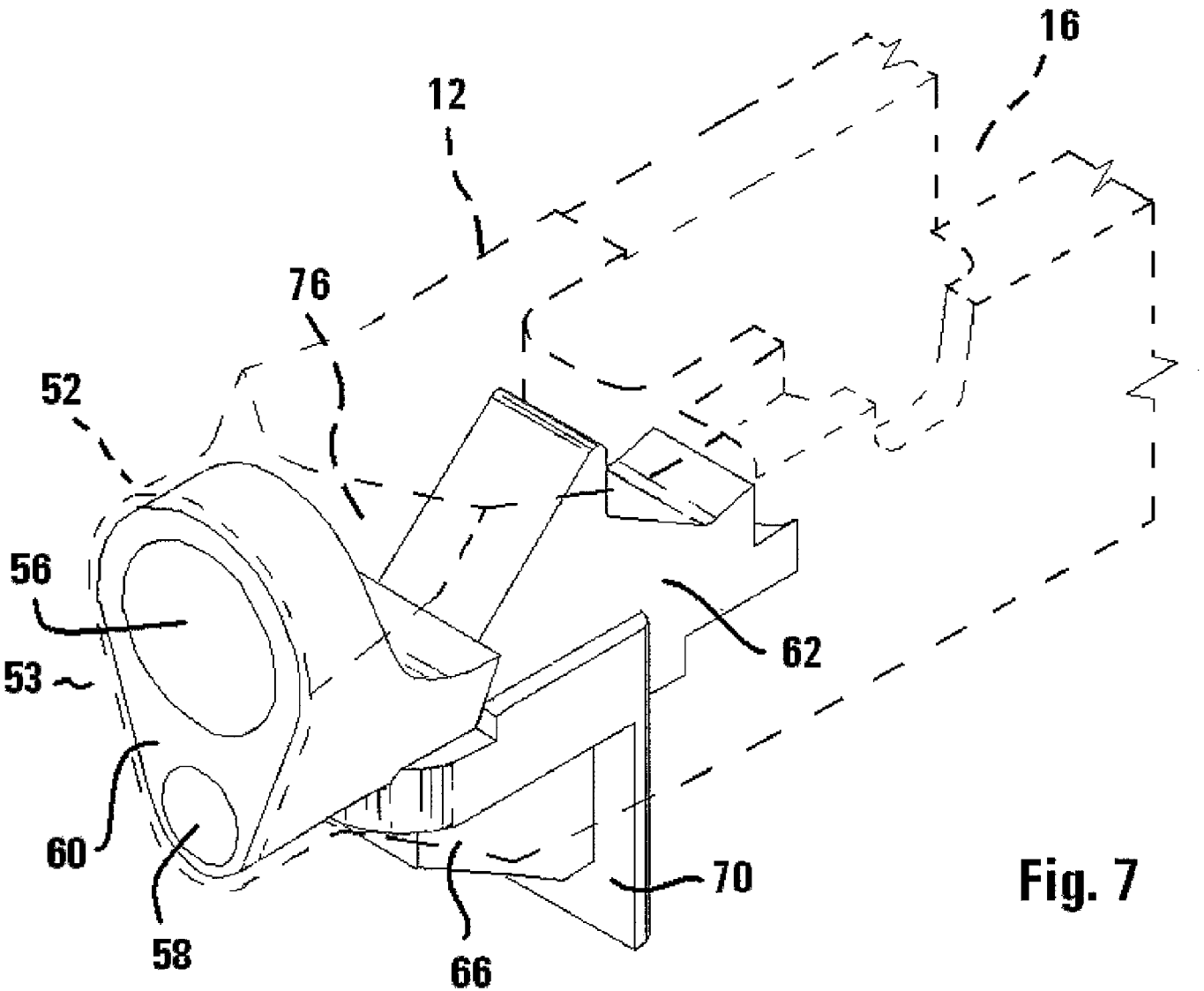
FIG. 7 is an assembled view of the mounting members shown in FIG. 6 in place in the composite material stock shell (shown in phantom lines)

Referring now also to FIGS. 6 and 7, members 60, 62 may be formed as a single unitary part. In preferred form, however, the insert members 60, 62 are constructed separately, but mechanically linked together for maximum strength when assembled into the structural shell 12. In the illustrated embodiment, the handguard mounting member 62 includes a socket or shelf 72 sized and shaped to closely receive the buttstock mounting member 60 and provide a firm interface therebetween. A machine screw 74 (FIGS. 2 and 3) may be threadingly engaged in a counter-sunk position through the offset opening 58. This interconnection assures that the buttstock 20 and hand grip 22 remain properly aligned and carries impact forces transferred through the connector inserts 60, 62 from the structural shell 12 in a uniform manner.

The attachment inserts 60, 62 are sized and shaped to provide surface area sufficient for bonding to the structural shell 12. Because it is not necessary, however, for the insert members 60, 62 to fill the entire space 76 within the structural shell 12 (FIG. 3) because the shell 12 is self-supporting, unnecessary mass can be eliminated from the insert members 60, 62.

Referring now to FIGS. 1-3, the structural shell 12 of the stock 10 may include a forearm portion 78 and/or a separable handguard 14 covering a portion of the barrel. In preferred form, the forearm portion 78 is integrally formed with the exterior shell wall 38. The forearm portion 78 and/or handguard 14 may be fitted with one or more axially-extending accessory mounting rails 80, 82, 84, 86. In preferred form, these are configured as a "Picatinny" or military standard 1913 (MIL-STD 1913) rail for mounting accessories such as tactical lights, night vision devices, laser sighting modules, foregrips, bipods, or other devices. The rails 80, 82, 84, 86 may be constructed from any appropriate material, but are preferably machined from hardened aluminum.

The handguard 14 may be constructed of similar composite materials and in a manner similar to that of the structural shell 12, described above. In the illustrated embodiment, the handguard 14 includes an offset portion 88 to allow clearance for reciprocation of the operating rod. The handguard 14 may be secured to the forearm by means of any desired mechanical connection. In preferred form, a series of axially spaced apart machine screws 32 may be used at lateral locations.

Figure 9:
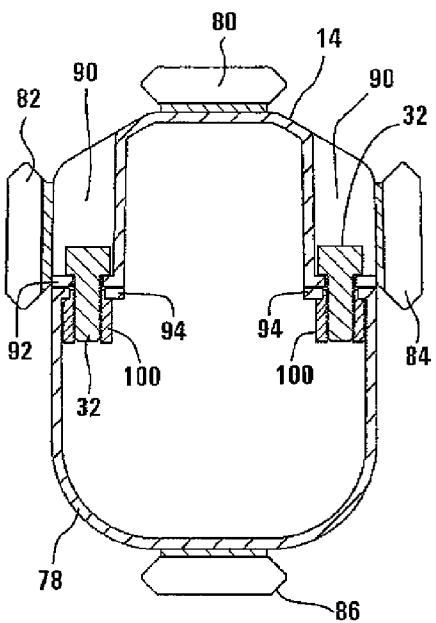
FIG. 9 is a cross-sectional view taken substantially along line 9-9 of FIG. 3.
Figure 8:
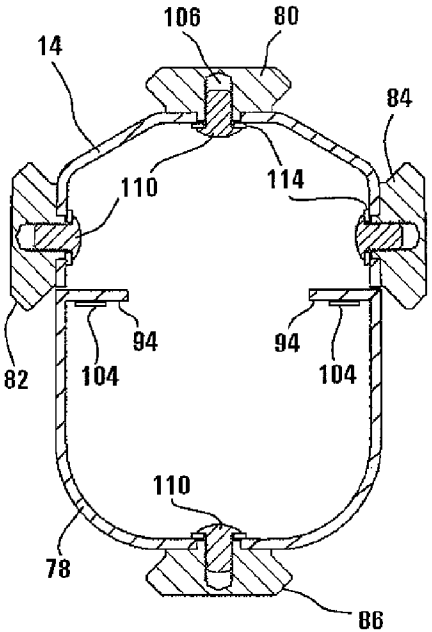
FIG. 8 is a cross-sectional view taken substantially along line 8-8 of FIG. 3.

Referring specifically to FIGS. 2, 8 and 9, it can be seen that the handguard 14 is provided with a series of indentations or recesses 90 for receiving the machine screws 32 and providing a substantially flat shelf or flange 92 against which a head portion of the machine screw 32 (or optional washer) bears. A corresponding, inwardly-extending flange 94 is provided along upper edges of the forearm 78. Openings 96 are formed in the flanges 94 corresponding in position with openings 98 provided in the floor portion 92 of each recess 98 of the handguard 14. An internally-threaded fastener component 100 (such as a common nut) is provided on the underside of flange 94 for receiving machine screw 32 and fastening the handguard 14 securely in place on the forearm 78.

In preferred form, the series of fastener components 100 for each side are formed as a single unit or nut plate 102. By providing a nut plate 102 in this manner, each of the fastener components 100 are held in proper alignment and spacing during installation/assembly and can be securely bonded in place on the under side of flanges 94, if desired. Between each fastener unit 100, the nut plate 102 includes a connecting web 104 which provides sufficient area for securely and permanently bonding to the composite material of the flanges 94. If desired, the nut plate 102 may include a raised boss at each fastener 100 location sized to fit securely into opening 96, thereby providing a mechanical interlock between the nut plate 102 and flange 94 for better carrying of shear forces.

Figure 10:
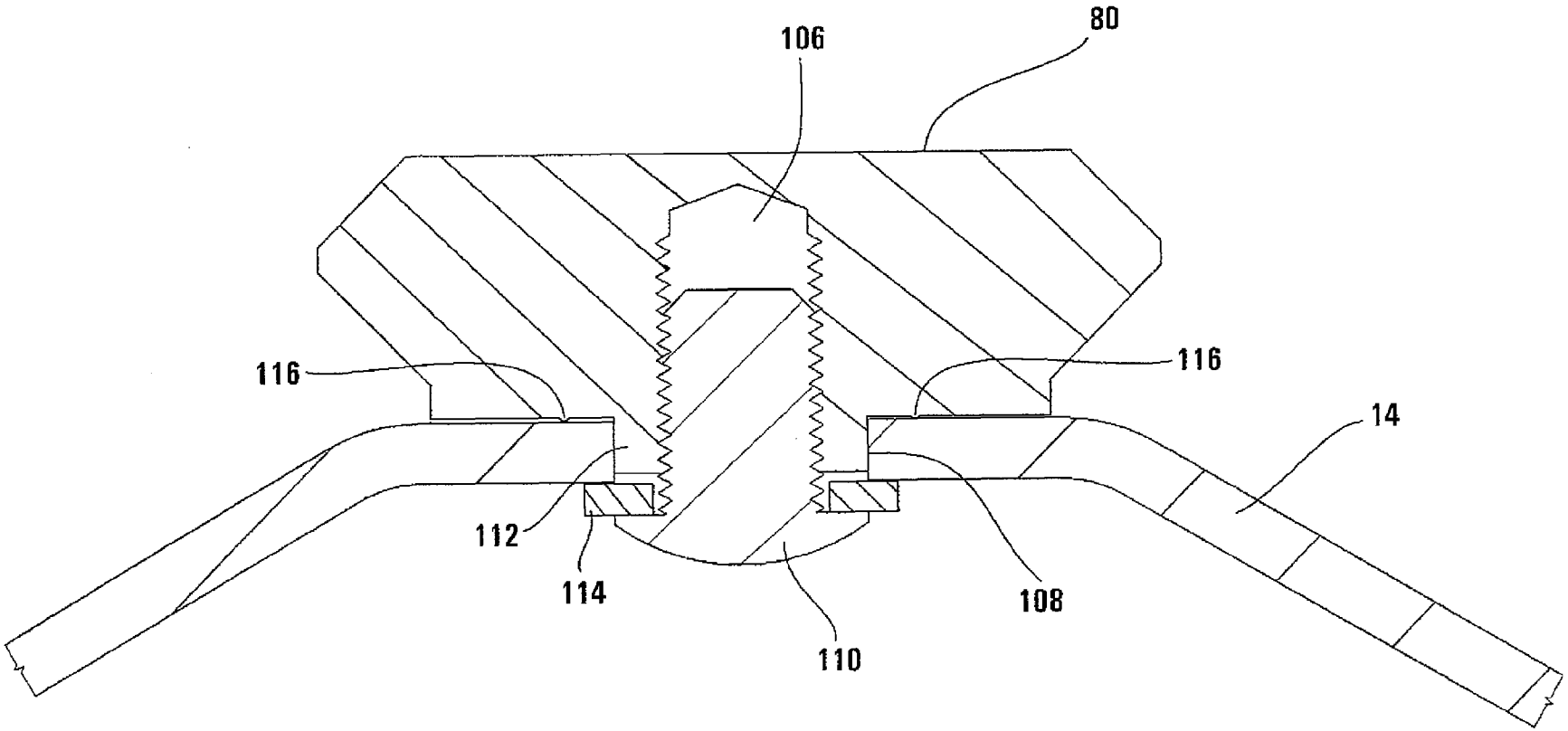
FIG. 10 is a detail sectional view showing the attachment of an accessory rail to the forearm enlarged from FIG. 8.

Referring now particularly to FIGS. 8 and 10, the accessory rails 80, 82, 84, 86 may be secured to the forearm 78 and/or handguard 14 through a combination of mechanical and adhesive bonding. Each of the accessory rails 80, 82, 84, 86 is provided with a series of blind-end, internally-threaded openings 106 on the underside. Correspondingly-spaced openings 108 are formed in the handguard 14 and/or forearm 78 through which threaded fasteners 110 (such as machine screws) may pass for engagement with the threaded opening 106. In preferred form, a raised annular boss 112 is formed on the underside of each accessory rail member 80, 82, 84, 86 to provide a further mechanical shear-carrying interlock. The boss 112 may, for example, have a diameter of 0.250 inches to be snugly received within the opening 108 and a height of 0.060 inches to correspond with a handguard 14 or forearm 78 material thickness of approximately 0.062 inches. A washer 114 (such as a cut washer or fender washer) may be used under the head of the fastener 110. Accordingly, the composite material of the handguard 14 and/or forearm 78 surrounding each opening 108 is placed in compression by the fastener 110 (and, optionally, washer 114). The transfer of shear forces between the accessory rail 80, 82, 84, 86 and the composite material, however, are to at least a significant extent transferred between the boss 112 and composite material of the handguard 14 and/or forearm 78, rather than loading the fastener component 110 in shear.

Additionally, in order to assure an even application of adhesive bonding material (such as epoxy resin), an additional annular shoulder, ring, or series of ridges or points 116 may be provided on the underside of the accessory rail 80, 82, 84, 86 in order to assure that a minimum spacing is provided for adhesive between the corresponding faces of the rails 80, 82, 84, 86 and handguard 14 and/or forearm 78. In preferred form, these spacing elements 116 have a height of approximately 0.008 inches and are laterally and axially spaced relative to the fastener 110 location so as to prevent any undesired rocking or flexing of the accessory rail 80, 82, 84, 86 when placed in tension by the fasteners 110.

It can readily be seen that there are numerous benefits that result from employing the concepts of the present invention. The foregoing description of a preferred embodiment has been presented for purposes of illustration and description. It is not intended to be exhaustive or to limit the invention to the precise form disclosed. Obvious modifications or variations are possible in light of the above teachings. For example, the self-supporting structural shell stock 10 may be adapted to a variety of other firearm models, types, or styles. Only some or none of the accessory rails 80, 82, 84, 86 may be selected, depending on the intended use of the firearm. Side accessory rails 82, 84 may be installed either along a sidewall of the handguard 14 (as shown) or sidewall of the forearm 78. The hand grip 22 could be formed integrally with the structural shell 12 rather than separately attached via a standardized complementary attachment means. The accessory rails 80, 82, 84, 86 may be made in any appropriate length corresponding to the length of the forearm 78 and/or intended use of the firearm. Moreover, top accessory rail 80 could extend rearward beyond the length of the handguard 14 and be supported at a rearward point by either the structural shell 12 or by the barreled action 18, such as at the dovetail groove 118 (FIG. 1) for the clip guide (not shown). The illustrated embodiment, however, allows for the use of a separate optics mount (not shown) such as one available from McCann Industries of Spanaway, Wash., mounted directly to the receiver.

The illustrated embodiment was chosen and described to provide the best disclosure of the principles of the invention and its practical application to thereby enable one of ordinary skill in the art to utilize the invention in various embodiments and with various modifications as are suited to the particular use contemplated. All such modifications and variations are within the scope of the invention as determined by any allowed claims when interrupted in accordance with the breadth to which they are fairly, legally and equitably entitled. The drawings and preferred embodiments do not and are not intended to limit the ordinary meaning of the claims and their fair and broad interpretation in any way.

What I claim is:

1. A self-supporting composite material stock for use with a firearm having a barreled action and with a separate buttstock, comprising:

a self-supporting structural shell made substantially of composite material, comprising:

an exterior wall;

an interior wall, at least some portion of which is inwardly spaced from the exterior wall;

wherein a space is defined between portions of the interior and exterior walls, said space being devoid of structural support material;

a cavity in the shell having an open top and configured to accept and secure a barreled action of a firearm by vertical insertion through the open top, the cavity having an interior volume defined at least in part by at least a portion of the interior wall; and a buttstock attachment member fixed to the structural shell and configured for attaching a detachable buttstock wherein a longitudinally-extending space is defined between lateral portions of the interior and exterior walls, the interior and exterior walls being connected together at vertically spaced apart positions, whereby a box beam structure is defined along opposite outboard positions relative to at least a portion of the barreled action.

2. The firearm stock of claim 1, wherein the space defined between portions of the interior and exterior walls is substantially hollow.

3. The firearm stock of claim 1, said stock further comprising a hand grip positioned adjacent a trigger of the firearm.

4. The firearm stock of claim 3, wherein the hand grip is removably attached to the stock.

5. The firearm stock of claim 1, wherein the composite material includes multiple layers of a resin impregnated fiber matrix.

6. The firearm stock of claim 5, wherein the fiber is carbon fiber.

7. The firearm stock of claim 5, wherein the fiber reinforcement is woven.

8. The firearm stock of claim 1, wherein the member is made of metal.

9. The firearm stock of claim 1, further comprising a hand grip attachment member configured for attaching a removable hand grip.

10. The firearm stock of claim 9, wherein the hand grip attachment member is fixed to a portion of the structural shell and having a mechanical engagement to cooperatively engage a removable hand grip.

11. The firearm stock of claim 10, wherein the member is made of metal.

12. The firearm stock of claim 10, wherein the buttstock attachment member and the hand grip attachment member are unitary.

13. The firearm stock of claim 10, wherein the buttstock attachment member and the hand grip attachment member are separate parts.

14. The firearm stock of claim 13, wherein the buttstock attachment member and the hand grip attachment member are mechanically interconnected.

15. The firearm stock of claim 1, further comprising at least one picatinny accessory attachment rail for attaching accessories in an orientation substantially parallel to the bore of a barreled action.

16. The firearm stock of claim 15, wherein the accessory attachment rail is made of metal.

17. The firearm stock of claim 16, wherein the accessory attachment rail is secured to the structural shell by a combination of adhesive and mechanical connection.

18. The firearm stock of claim 1, wherein the stock includes a forearm portion and a separable handguard portion, at least part of the handguard portion positioned over and covering at least a portion of the barrel of the barreled action.

19. The firearm stock of claim 18, further comprising at least one picatinny accessory attachment rail for attaching accessories in an orientation substantially parallel to the bore of a barreled action and positioned on at least one of the forearm portion and the handguard portion.

20. The firearm stock of claim 18, wherein the handguard portion is removably attached to forearm portion by threaded engagement between corresponding fastener components, one of the components being fixed to the forearm portion.

21. The firearm stock of claim 20, wherein a plurality of the fixed fastener components are formed in a unitary component and then fixed to the forearm portion of the structural shell as a unit so as to maintain correct relative position and alignment during fabrication of the stock.

22. The firearm stock of claim 1, wherein the stock is configured to engage the barreled action of a rifle for use without modification to the barreled action.

23. The firearm stock of claim 1, wherein the interior wall and exterior wall are manufactured as separately cured components and then permanently assembled to form the self-supporting structural shell.

24. The firearm stock of claim 23, wherein the interior wall and exterior wall are composed of like composite material.

* * * * *